US006468364B1

(12) United States Patent
Marecic

(10) Patent No.: US 6,468,364 B1
(45) Date of Patent: Oct. 22, 2002

(54) ANTICORROSION TREATMENT

(75) Inventor: Shannon Marecic, Shellharbour (AU)

(73) Assignee: BHP Steel (JLA) Pty Ltd, Sydney (AU)

( * ) Notice: Subject to any disclaimer, the term of this patent is extended or adjusted under 35 U.S.C. 154(b) by 0 days.

(21) Appl. No.: 09/701,285

(22) PCT Filed: May 28, 1999

(86) PCT No.: PCT/AU99/00419

§ 371 (c)(1),
(2), (4) Date: Feb. 26, 2001

(87) PCT Pub. No.: WO99/61681

PCT Pub. Date: Dec. 2, 1999

(30) Foreign Application Priority Data

May 28, 1998 (AU) ..... PP3751

(51) Int. Cl.[7] ..... C23C 22/07

(52) U.S. Cl. ..... 148/253; 148/261; 106/14.12; 428/472.3; 252/389.23; 252/389.54

(58) Field of Search ..... 148/253, 261; 106/14.12; 428/472.3; 252/389.23, 389.54

(56) References Cited

U.S. PATENT DOCUMENTS

| | | | |
|---|---|---|---|
| 3,697,332 | A | 10/1972 | Kuehner |
| 4,775,427 | A | 10/1988 | Portz et al. |
| 5,498,759 | A | 3/1996 | Nakada et al. |
| 5,520,750 | A | 5/1996 | Riley |
| 5,683,816 | A | 11/1997 | Goodreau |

FOREIGN PATENT DOCUMENTS

| | | |
|---|---|---|
| AU | A-22855/92 | 3/1993 |

*Primary Examiner*—John Sheehan
*Assistant Examiner*—Andrew L. Ottmans
(74) *Attorney, Agent, or Firm*—Miles & Stockbridge P.C.; John C. Kerins

(57) ABSTRACT

An anticorrosion treatment of an aluminium/zinc alloy surface is disclosed. The treatment includes the steps of forming on the alloy surface a coating of a solution which contain 5–40 grams of molybdenum per litre of the solution, 2–19% by volume of a phosphoric acid, and a surface etchant. The treatment also includes drying the coating to form a dried coating having a loading of molybdenum of at least 10 $mg/m^2$ of the dried coating and of phosphorus of at least 15 $mg/m^2$ of the dried coating.

15 Claims, No Drawings

ANTICORROSION TREATMENT

BACKGROUND OF THE INVENTION

1. Field of the Invention

The present invention relates to an anti-corrosion treatment of aluminium/zinc alloy surfaces.

In particular, although by no means exclusively, the present invention relates to an anticorrosion treatment of steel strip having a coating of an Al/Zn alloy.

2. Description of Related Art

Zinc, aluminium and/or combinations of aluminium and zinc are widely used as surface coatings, particularly but not exclusively for steel for protection against corrosion. In practice, however, the zinc or Al/Zn coatings are susceptible to white corrosion (white rust) or black corrosion (black rust) respectively when exposed to the atmosphere due to reactions with moisture. Such corrosion is detrimental to the surface appearance and generally makes coated steel substrates unacceptable commercially despite the fact that the overall service life of the coated steel may remain the same. Further the formation of corrosion products generally interferes with finishing operations. The ability to resist such corrosion is referred to herein as wet stack performance.

In order to inhibit the formation of corrosion on coated surfaces it is generally accepted that the treatment of a surface with a chromate imparts anticorrosive properties and this type of treatment is generally referred to as chromate passivation. However, chromate is highly toxic to exposed workers and, due to its high toxicity, disposal of chromium residues is difficult. Further, in various markets yellow discolouration of treated coated surfaces caused by the chromate is considered to be an unacceptable product attribute.

In order to overcome the problems associated with chromate passivation, phosphate coatings have been used. However the anticorrosion properties of phosphate have been found to be far inferior to the above-mentioned chromate treatment.

U.S. Pat. No. 4,385,940 assigned to Kobe Steel, Limited discloses an anticorrosive treatment for preventing white rust on galvanized steel which includes the steps of applying to the surface of a galvanized steel sheet an acidic solution containing molybdic acid or a molybdate in a concentration of 10–200 g/l (calculated as molybdenum) and adjusted to a pH of 1 to 6 by addition of an organic or inorganic acid. However, whilst the anticorrosive treatment described in the US patent works well for galvanised steel, it has been found that the corrosion resistance of Al/Zn alloy surfaces treated with the above solution is inferior to the chromate treated substrates under certain conditions and the treated surfaces suffer from an undesirable degree of discolouration. Moreover, molybdate treated surfaces of such material have been observed to change from a pale yellow/blue to a strong green colour when stored for periods of time in excess of 24 hours.

International application PCT/US97/00012 (WO97/27001) in the name of Henkel Corporation discloses an anti-corrosive treatment for aluminium/zinc alloy surfaces which is based on the use of a solution that includes phosphate anions and molybdenum anions and/or compounds in which the molybdenum has an oxidation state less than +6.

It is an object of the present invention to provide an alternative anticorrosion treatment for Al/Zn alloy surfaces.

SUMMARY OF THE INVENTION

According to the present invention there is provided an anticorrosion treatment of an aluminium/zinc alloy surface which includes the steps of:

(i) forming on the surface a coating of a solution which contains 5–40 grams of molybdenum per litre of the solution, 2–19% by volume of a phosphoric acid, and a surface etchant; and (ii) drying the coating to form a dried coating having a loading of molybdenum of at least 10 mg/m$^2$ of the dried coating and of phosphorus of at least 15 mg/m$^2$ of the dried coating.

The amount of 2–19 volume % of the phosphoric acid equates to 9.1 to 86.9 grams phosphorus per litre of the solution.

DETAILED DESCRIPTION OF THE PREFERRED EMBODIMENT

The applicant has found in laboratory and outdoors testing that coatings having the above molybdenum and phosphorous loadings exhibit excellent levels of corrosion resistance and lower levels of discolouration than prior art coatings.

Whilst not wishing to be bound by the following comments in this paragraph, the applicant believes that the excellent performance of coatings having the above loadings of molybdenum and phosphorus is due to the above-described anticorrosion treatment initially forming a layer of zinc phosphate on the surface and then forming a layer of molybdenum phosphate on that layer.

The applicant has found that the excellent performance of coatings having the above loadings of molybdenum and phosphorus was achieved without the need to ensure that the molybdenum in the solution had an oxidation state less than +6 and without the use of reducing agents in the solution to achieve this outcome, as is the case with International application PCT/US97/00012 (WO97/27001).

In any given situation, the amounts of molybdenum and phosphoric acid that are necessary to obtain the product loadings of at least 10 mg/m2 molybdenum and at least 15 mg/m$^2$ phosphorus depends on a range of factors, such as, by way of example, the zinc concentration of the Al/Zn alloy, pH of the solution, and the thickness of the final coating.

Preferably the Al/Zn alloy contains 25–75 wt.% aluminium.

More preferably the Al/Zn alloy is aluminium rich.

Preferably the surface coating formed in step (i) is 3–5 micron thick.

The surface coating may be formed by any suitable means.

By way of example, the coating may be formed by applying the solution to the Al/Zn alloy surface by means of a roller-coater.

Alternatively, the coating may be formed by firstly dipping the Al/Zn alloy surface into a bath of the solution or spraying the solution onto the surface to form a coating having a thickness greater than 5 micron and thereafter removing excess solution by means of a squeegee roller or other suitable means.

The solution may be applied to the Al/Zn alloy surface at any suitable temperature.

Preferably the solution application temperature is less than 35° C.

Preferably the pH of the solution is less than 3 when it is initially applied to the Al/Zn alloy surface.

More preferably the pH of the solution is less than 2.6 when it is initially applied to the Al/Zn alloy surface.

Preferably the molybdenum in the solution has an oxidation state of +6.

The coating formed in step (i) may be dried by any suitable means in step (ii) that ensures the coating is thoroughly dried.

Preferably step (ii) includes drying the coating formed in step (i) at temperatures of at least 60° C.

More preferably step (ii) includes drying the coating formed in step (i) by induction heating.

Preferably, the dried coating formed in step (ii) is 20–100 nanometers thick.

More preferably the dried coating is 30–50 nanometers thick.

Preferably the molybdenum loading of the dried coating is at least 15 $gm/m^2$ of the coating.

Preferably the phosphorus loading of the coating is at least 20 $gm/m^2$ of the coating.

Preferably the Al/Zn alloy is a coating on a steel strip.

Preferably the coating is continuous.

Preferably the solution contains 5–30 g/l molybdenum.

Preferably the solution contains at least 13.5 g/l molybdenum.

Preferably the solution contains less than 20 g/l molybdenum.

Preferably the molybdenum is added as a salt.

Preferably the molybdenum salt is ammonium molybdate.

Other suitable molybdenum salts include sodium and potassium molybdate.

Preferably the phosphoric acid is concentrated phosphoric acid. The term "concentrated" is understood to mean that the acid is in the form of an aqueous solution in which at least 80 volume % of the solution is acid and less than 20 volume % is water.

Preferably the solution contains 2–10% by volume of the phosphoric acid.

More preferably the solution contains at least 3 volume % of the phosphoric acid.

It is preferred particularly that the solution contain at least 4 volume % of the phosphoric acid.

Preferably the phosphoric acid is orthophosphoric acid.

Preferably the surface etchant is a fluorine containing compounds, such as sodium fluoride.

Preferably the solution contains at least 0.3 g/l fluorine.

More preferably the solution contains at least 0.5 g/l fluorine.

The solution may contain other constituents.

By way of example, the solution may contain up to 5 g/l vanadium.

According to the present invention there is also provided an Al/Zn alloy surface treated in accordance with the above-described anticorrosion treatment.

According to the present invention there is also provided a solution for use in the above-described anticorrosion treatment which includes 5–40 g/l molybdenum, 2–19% by volume of a phosphoric acid, and an etchant.

Preferably the molybdenum in the solution has an oxidation state of +6.

Preferably the solution contains 5–30 g/l molybdenum.

More preferably the solution contains more than 13.5 g/l molybdenum.

More preferably the solution contains less than 20 g/l molybdenum.

In order to investigate the performance of the present invention the applicant carried out a series of wet-stack laboratory experiments on ZINCALUME panels treated with the range of treatment solutions summarised in Table 1.

In order to simulate conditions expected in a commercial production line the treatment solutions were applied by dipping the panels for 4 seconds in the treatment solution and then sheen spinning excess solution. The coatings on the panels were then thoroughly dried using a convection air drier.

The molybdenum, vanadium, phosphorus and fluorine in the treatment solutions used in samples 2–8 were added as ammonium molybdate, ammonium vanadate, orthophosphoric acid, and sodium fluoride respectively. The orthophosphoric acid was either 81 or 85% aqueous orthophosphoric acid.

The pH of the treatment solutions varied between 1.5 and 2.2.

The dried coatings of samples 2–8 were 20–100 nanometers thick. The dried coatings of samples 2–5 had loadings of molybdenum and phosphorus above 10 and 40 $mg/m^2$, respectively.

The wet-stack experiments were carried out over a 4 week period and at 40° C.

Details of the colour and corrosion resistance of each panel and the conclusion of the wet-Stack experiments are set out in Table 1.

TABLE 1

| Sample No | Treatment Solution | Colour After 24 Hours After Passivation | Corrosion Resistance | Pass or Fail Corrosion Test |
|---|---|---|---|---|
| 1 | Chromated ZINCALUME | Clear | No sign of corrosion | Pass |
| 2 | 27 g/L Mo, 0.5 g/L V, 10% $H_3PO_4$ (45.6 g/L P), 0.4 g/L F, pH 1.5 | Blue & green. Colour varied at edges considerably | No sign of black staining. 5% of red rust on cut edges | Pass |
| 3 | 13.5 g/L Mo, 2 g/L V, 5% $H_3PO_4$ (45.6 g/L P), 0.7 g/L F, pH 1.5 | Light Tan | No sign of black staining. 5% of red rust on cut edges | Pass |
| 4 | 13.5 g/L Mo, 0 g/L V, 5% $H_3PO_4$ (22.8 g/L P), 0.7 g/L F | Very Light Tan | 5% black staining (very light grey in colour). 5–10% red rust around the cut edges | Pass |
| 5 | 13.5 g/L Mo, 2 g/L V, 2% $H_3PO_4$ (9.1 g/L P), 0.7 g/L F, pH 1.9 | Light Tan | No sign of black staining. 15–20% white/grey corrosion | Pass |
| 6 | 13.5 g/L Mo, 2 g/L V, 5% $H_3PO_4$ (22.8 g/L P), 0 g/L F | Light Tan | 100% black staining and 100% red rust on cut edges. Note 2/6 panels had no sign of black staining (problem with variability) | Fail |

TABLE 1-continued

| Sample No | Treatment Solution | Colour After 24 Hours After Passivation | Corrosion Resistance | Pass or Fail Corrosion Test |
|---|---|---|---|---|
| 7 | 8 g/L MO, 1 g/L V, 1.5% $H_3PO_4$ (22.8 g/L P), 0 g/L F | Clear | 100% black staining and 100% red rust on cut edges | Fail |
| 8 | 5.4 g/L MO, 1 g/L V, 1.5% $H_3PO_4$ (22.9 g/L P), 0.2 g/L F | Clear | 100% black staining and 100% red rust on cut edges | Fail |
| 9 | Untreated ZINCALUME | Clear | 100% black staining. 100% red rust on cut edges | Fail |

It is clear from the table that the treated panels of samples 3–5 in accordance with the present invention had comparable colour and samples 2–3 had comparable corrosion resistance to the chromate ZINCALUME panel of sample 1 and significantly better corrosion resistance than the treated panels of panels 6–8 and the untreated ZINCALUME panel of sample 9.

Although the invention has been described with reference to specific examples, it would be appreciated by those skilled in the art that the invention may be embodied in many other forms.

What is claimed is:

1. An anticorrosion treatment of an aluminium/zinc alloy surface which includes the steps of:

(i) forming on the surface a coating of a solution which contain 5–40 grams of molybdenum per litre of the solution, 2–19% by volume of a phosphoric acid, and a surface etchant; and (ii) drying the coating to form a dried coating having a loading of molybdenum of at least 10 $mg/m^2$ of the dried coating and of phosphorous of at least 15 $mg/m^2$ of the dried coating;

wherein the molybdenum in the solution has an oxidation state of +6.

2. The treatment defined in claim 1 wherein the Al/Zn alloy contains 25–75 wt. % aluminium.

3. The treatment defined in claim 2 wherein the Al/Zn alloy is aluminium rich.

4. The treatment defined in claim 1 wherein step (i) includes forming the surface coating by applying the solution to the Al/Zn alloy surface at a solution application temperature of less than 35° C.

5. The treatment defined in claim 1 wherein the pH of the solution is less than 3 when it is initially applied to the Al/Zn alloy surface.

6. The treatment defined in claim 5 wherein the pH of the solution is less than 2.6 when it is initially applied to the Al/Zn alloy surface.

7. The treatment defined in claim 1 wherein the solution contains 5–30 g/l molybdenum.

8. The treatment defined in claim 1 wherein the solution contains at least 13.5 g/l molybdenum.

9. The treatment defined in claim 1 wherein the solution contains less than 20 g/l molybdenum.

10. The treatment define in claim 1 wherein the solution contains 2–10% by volume of the phosphoric acid.

11. The treatment defined in claim 1 wherein the solution contains at least 4% by volume of the phosphoric acid.

12. The treatment defined in claim 1 wherein the surface etchant is a fluorine-containing compound and the solution contains at least 0.3 g/l fluorine.

13. The treatment defined in claim 12 wherein the solution contains at least 0.5 g/l fluorine.

14. An Al/Zn alloy having a corrosion resistant surface obtained by:

(i) forming on the surface a coating of a solution which contain 5–40 grams of molybdenum per litre of the solution, 2–19% by volume of a phosphoric acid, and a surface etchant, wherein the molybdenum in the solution has an oxidation state of +6; and (ii) drying the coating to form a dried coating having a loading of molybdenum of at least 10 $mg/m^2$ of the dried coating and of phosphorous of at least 15 $mg/m^2$ of the dried coating.

15. A solution for use in an anticorrosion treatment for a surface of an aluminum/zinc alloy, said solution comprising 5–40 g/l molybdenum, 2–19% by volume of phosphoric acid, and a surface etchant, wherein the molybdenum in the solution has an oxidation state of +6; and wherein said solution is adapted to form a dried coating on said surface of said aluminum/zinc alloy, said dried coating having a loading of molybdenum of at least 10 $mg/m^2$ of the dried coating and a loading of phosphorous of at least 15 $mg/m^2$ of the dried coating.

* * * * *